US008800670B2

(12) United States Patent
Lembcke et al.

(10) Patent No.: US 8,800,670 B2
(45) Date of Patent: Aug. 12, 2014

(54) FILLER RINGS FOR SWELLABLE PACKERS AND METHOD FOR USING SAME

(75) Inventors: Jeffrey J. Lembcke, Cypress, TX (US); Patrick J. Zimmerman, Houston, TX (US); David Ward, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 172 days.

(21) Appl. No.: 12/853,091

(22) Filed: Aug. 9, 2010

(65) Prior Publication Data

US 2012/0031608 A1 Feb. 9, 2012

(51) Int. Cl.
*E21B 23/00* (2006.01)
*E21B 33/12* (2006.01)

(52) U.S. Cl.
USPC ..... 166/387; 166/118; 175/230

(58) Field of Classification Search
USPC ..... 166/118, 387; 175/230
See application file for complete search history.

(56) References Cited

U.S. PATENT DOCUMENTS 4,595,052 A 6/1986 Kristiansen
7,304,098 B2 * 12/2007 Li et al. ..... 523/130
7,387,158 B2 6/2008 Murray et al.
8,141,626 B2 3/2012 Freyer
2005/0016740 A1 1/2005 Aldaz et al.
2006/0047028 A1 * 3/2006 Li et al. ..... 524/35
2008/0210418 A1 * 9/2008 Knippa et al. ..... 166/118
2009/0179383 A1 * 7/2009 Koloy et al. ..... 277/338
2009/0260801 A1 * 10/2009 Nutley et al. ..... 166/118
2009/0277652 A1 11/2009 Nutley et al.
2010/0116496 A1 5/2010 Allen et al.
2010/0126735 A1 5/2010 Allison et al.

FOREIGN PATENT DOCUMENTS

GB 2411918 A 9/2005
RU 2151854 6/2000

OTHER PUBLICATIONS

European Search Report received in corresponding EP Application No. 11250712, dated Nov. 12, 2013.

* cited by examiner

*Primary Examiner* — Kenneth L Thompson
*Assistant Examiner* — Catherine Loikith
(74) *Attorney, Agent, or Firm* — Wong, Cabello, Lutsch, Rutherford & Brucculeri LLP

(57) ABSTRACT

A swellable packer with an enhanced sealing ability comprises a tubular body, a swellable element, and a filler ring disposed about the tubular body between the tubular body and the swellable element. The filler ring is formed of a material harder than the swellable element. The filler ring enhances the sealing ability of the swellable packer. Any number of filler rings may be used. The filler ring or rings may be fixed to the tubular body or may be unfixed.

17 Claims, 4 Drawing Sheets

FILLER RINGS FOR SWELLABLE PACKERS AND METHOD FOR USING SAME

TECHNICAL FIELD

The present invention relates to the field of packers, and in particular to swellable packers.

BACKGROUND ART

In the field of oil and gas exploration and production, various tools are used to provide a fluid seal between two components in a wellbore. Isolation tools have been designed for sealing an annulus between two downhole components to prevent undesirable flow of wellbore fluids in the annulus. For example, a packer may be formed on the outer surface of a completion string which is run into an outer casing or an uncased hole. The packer is run with the string to a downhole location, and is inflated or expanded into contact with the inner surface of the outer casing or openhole to create a seal in the annulus. To provide an effective seal, fluid must be prevented from passing through the space or micro-annulus between the packer and the completion, as well as between the packer and the outer casing or openhole.

Isolation tools are not exclusively run on completion strings. For example, in some applications they form a seal between a mandrel which forms part of a specialized tool and an outer surface. In other applications they may be run on coiled tubing, wireline, and slickline tools.

Conventional packers are actuated by mechanical or hydraulic systems. More recently, packers have been developed which include a mantle of swellable elastomeric material formed around a tubular body. The swellable elastomer is selected to expand on exposure to at least one predetermined fluid, which may be a hydrocarbon fluid or an aqueous fluid. The packer may be run to a downhole location in its unexpanded state, where it is exposed to a wellbore fluid and caused to expand. The design, dimensions, and swelling characteristics are selected such that the swellable mantle expands to create a fluid seal in the annulus, thereby isolating one wellbore section from another. Swellable packers have several advantages over conventional packers, including passive actuation, simplicity of construction, and robustness in long term isolation applications.

FIG. 1 illustrates a swellable packer 100 according to the prior art formed on a tubular body 110 such as a mandrel having a longitudinal axis L. The packer 100 comprises a swellable element 120 disposed about the body 110. The swellable element 120 is formed from an elastomeric material selected to expand on exposure to at least one predetermined fluid. Such materials are known in the art.

The dimensions of the packer 100 and the characteristics of the swellable material of the swellable element 120 are typically selected such that the swellable element 120 forms a seal in use, which substantially prevents the flow of fluids past the body 110. On exposure to a wellbore fluid in the annulus surrounding the body 110, such as a hydrocarbon fluid, the swellable element 120 swells and its outer diameter increases until it contacts the surface of the wellbore to create a seal in the annulus. The seal prevents flow of fluid in the wellbore annulus between a volume above the packer 100 and a volume below the packer 100. Swellable packers are suitable for use in uncased hole and in a cased hole, in which case the swellable element 120 would form a seal against the interior surface of the outer casing.

Typically a packer will be constructed for a specific application and incorporated into a casing string or other tool string by means of threaded couplings, not shown in FIG. 1. In addition, although held in place by a simple offset in the example packer 100 of FIG. 1, the swellable element 120 may be held in place by gage rings or other attachment devices at either longitudinal end of the swellable element 120.

Swellable packers such as illustrated in FIG. 1 may be made with swellable elements 120 of various lengths to suit the application, typically ranging from 1 foot to 30 feet in length, although shorter or longer lengths are known. Furthermore, although a single swellable element 120 is illustrated in FIG. 1, packers 100 may employ multiple swellable elements 120 as desired.

SUMMARY OF INVENTION

By placing filler rings spaced along the packing element length, pinch points for the elastomer can be created that increase the rubber pressure in the element over the rings and help distribute the pressure holding capability along the length of the element. These rings may be fixed to the mandrel to resist movement so that the rubber will try to move past the ring when pressured against, but will be forced into the restriction above the ring creating a seal point. The filler rings make possible a shorter element that holds higher pressures than without the rings.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

In the following description, for purposes of explanation, numerous specific details are set forth in order to provide a thorough understanding of the invention. It will be apparent, however, to one skilled in the art that the invention may be practiced without these specific details. In other instances, structure and devices are shown in block diagram form in order to avoid obscuring the invention. References to numbers without subscripts or suffixes are understood to reference all instance of subscripts and suffixes corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

The terms "upper," "lower," "above," "below," "up," and "down" are used herein to indicate relative positions in the wellbore. The invention also has applications in wells that are deviated or horizontal, and when these terms are applied to such wells they may indicate "left," "right," or other relative positions in the context of the orientation of the well.

How sealing pressure is distributed across the length of the swellable element 120 is unclear in the art, with uncertainty whether it actually seals along the entire length, or just for a short length, such as a couple of inches, against the gage ring at either end. Conventionally, packer manufacturers have attempted to achieve better sealing by making the packing element longer to increase its pressure rating or by providing expandable back-ups at either end of the packing element.

Figure 1:
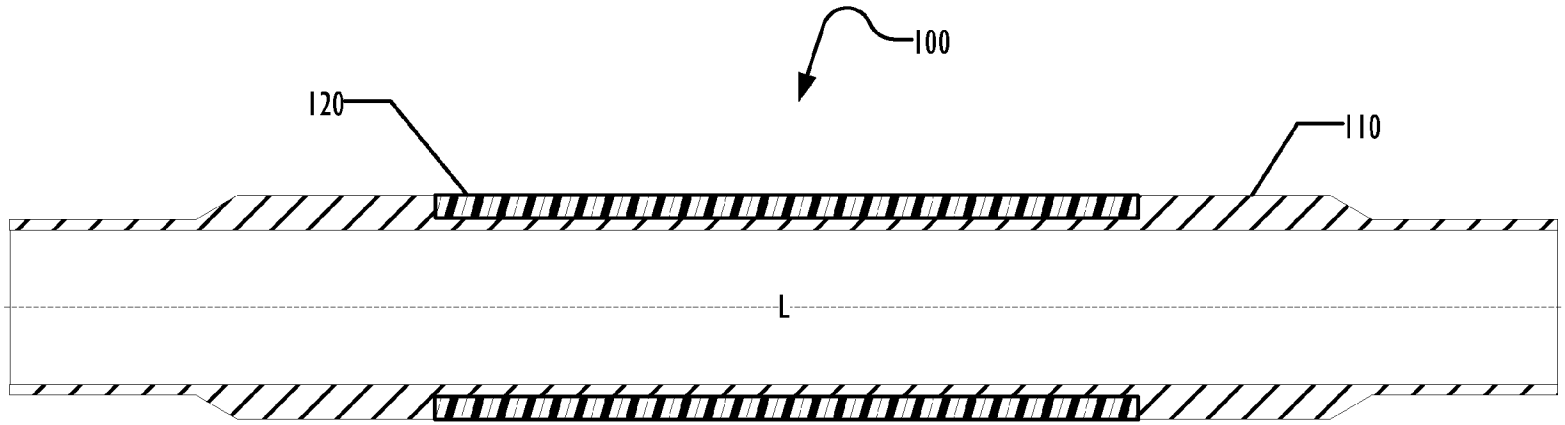
FIG. 1 (PRIOR ART)
FIG. 1 is a cutaway view of a swellable packer according to the prior art.
Figure 2:
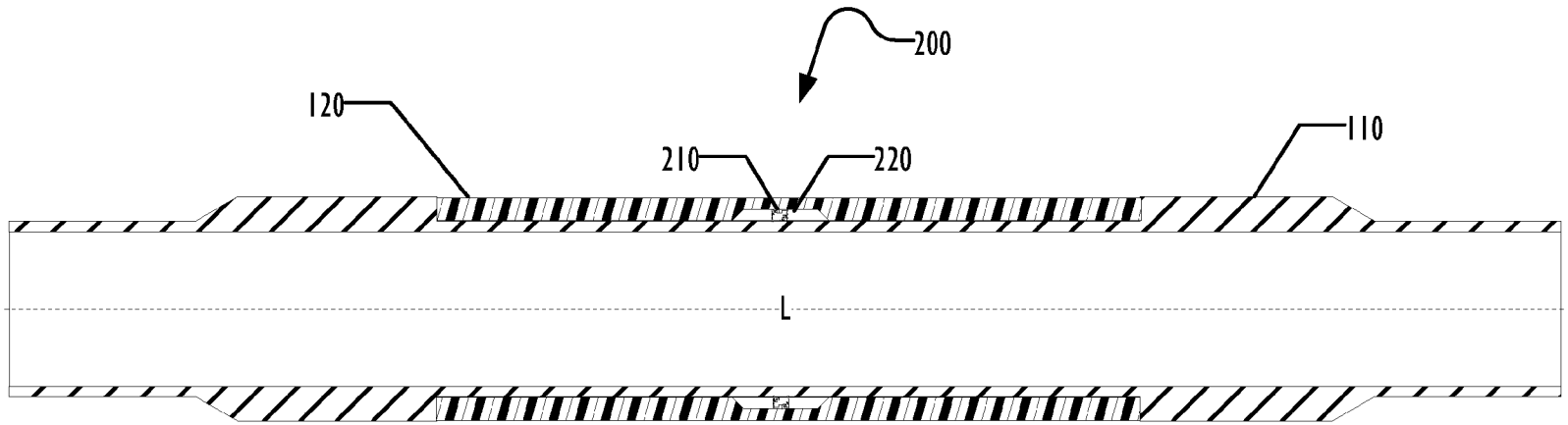
FIG. 2 is a cutaway view of a swellable packer according to one embodiment that employs a single filler ring.

FIG. 2 is a cutaway view illustrating a swellable packer 200 according to one embodiment. In addition to the elements described above in FIG. 1, a filler ring 210 is positioned between the swellable element 120 and the mandrel 110. The filler ring 210 as illustrated is fixed to the mandrel 110 with at least one screw 220. In other embodiments, other techniques for fixing the filler ring 210 to the mandrel 110 may be used, such as bonding the filler ring 210 to the mandrel. In yet other embodiments, the filler ring 210 may not be fixed to the mandrel, and instead is held in place by friction with the swellable element 120 and the mandrel 110.

The filler ring 210 in one embodiment is formed of an elastomeric material that is harder than the material used for the swellable element 120. Other types of materials may be used, including both metallic and non-metallic materials that are harder than the swellable element 120. In one embodiment, the filler ring 210 is formed of an elastomeric swellable material that has a higher durometer value than the swellable material of the swellable element 120. Upon exposure to the triggering fluid for the swellable materials of the swellable element 120 and the filler ring 210, both materials would expand.

The filler ring 210 provides a "pinch point" that increases the holding and the sealing capability of the swellable element 120 at or near the filler ring 210. As pressure is exerted up or down hole, movement of the swellable element 120 is restricted at the filler ring 210, increasing the sealing pressure exerted by the swellable element 120 at that location. In one embodiment, the filler ring 210 may have an outer diameter 0.254 cm (0.1 inches) less than the outer diameter of the swellable element 120.

Figure 3:
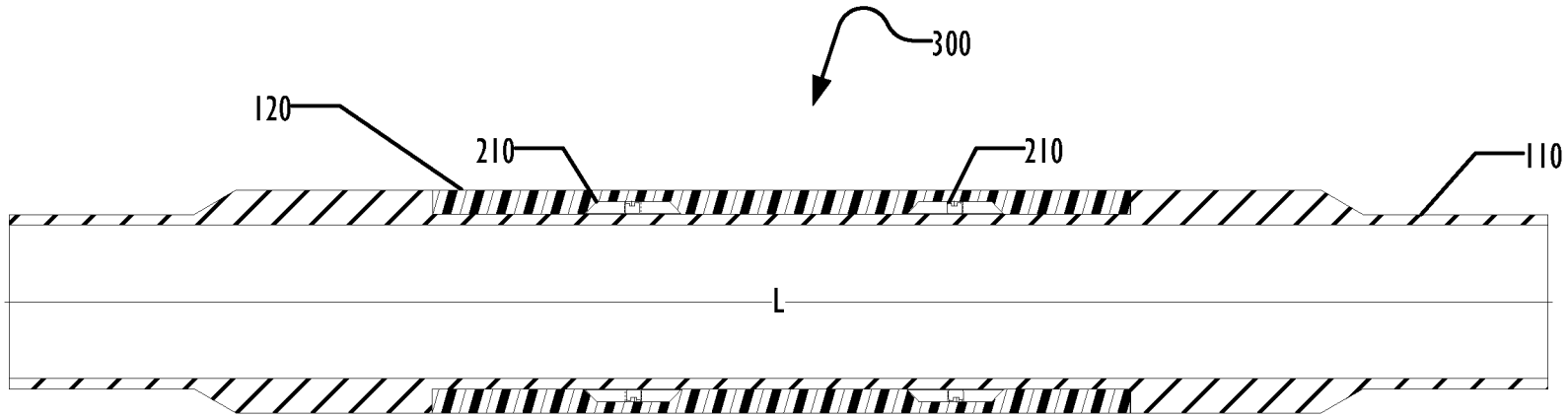
FIG. 3 is a cutaway view of a swellable packer according to one embodiment that employs multiple filler rings.

FIG. 3 is a cutaway view of a swellable packer according to another embodiment in which a plurality of filler rings 210 are placed between the swellable element 120 and the mandrel 110. The plurality of filler rings 210 are evenly spaced along the length of the swellable element 120 in one embodiment. In other embodiments, the filler rings 210 may be unevenly spaced with any desired separations between each of the rings. Some of the filler rings 210 may be fixed in place, while others may be unfixed, or all may be fixed or unfixed to the mandrel 110, as desired.

In one embodiment, the swellable element 120 may be fixed to the mandrel across the length of the swellable element 120, by bonding the swellable element 120 to mandrel 110. In another embodiment, the swellable element 120 may be fixed in place at each end by gage rings 410. If the portion of the swellable element 120 between the gage rings 410 is left unbonded, a low pressure chamber may be formed by the mandrel 110 and a surface of the swellable element 120, which may help keep the swellable element from excessive movement radially away from the outer surface of the mandrel 110 during insertion of the swellable packer 400. Alternately, multiple low-pressure chambers may be formed by bonding of the swellable element 120 at a plurality of locations along its length at any desired plurality of locations.

The swellable packers illustrated in FIGS. 1-4 omit any other elements that may be disposed with the mandrel 110 for clarity. Other elements may be disposed on the mandrel 110 as desired. The shape of the mandrel 110 in the figures is illustrative and by way of example only and other shapes may be used. The mandrel 110 may be formed of either metallic or non-metallic material, as desired.

Although only one swellable element 120 is shown disposed on the mandrel 110 in FIGS. 1-4, in some embodiments multiple swellable elements 120 may be disposed on the mandrel 110, some or all of which may be positioned with filler rings 210 as described above.

Figure 4:
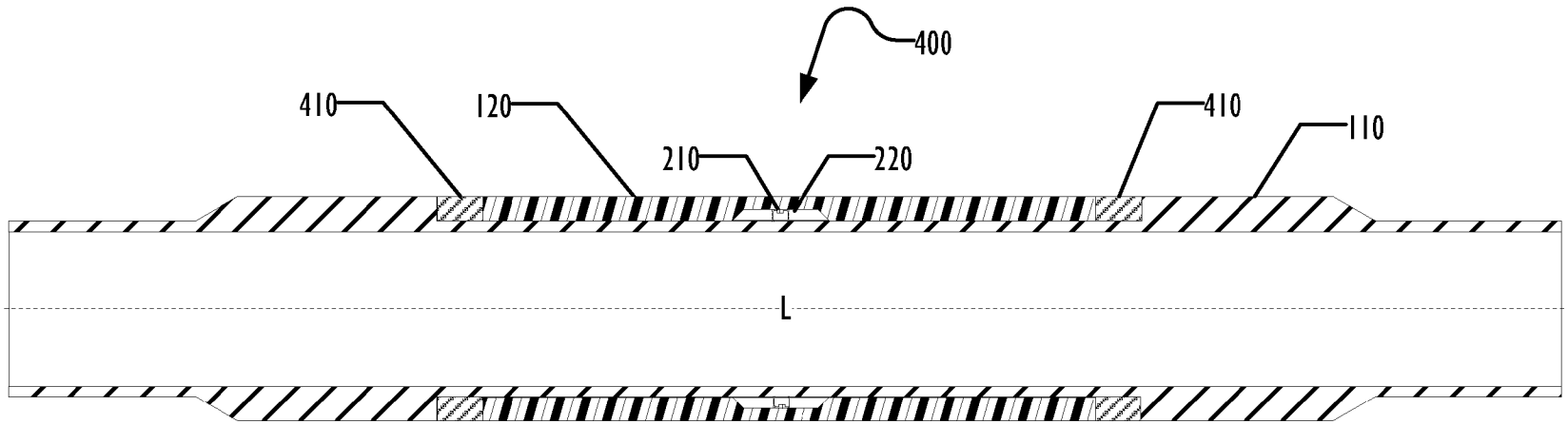
FIG. 4 is a cutaway view of a swellable packer according to one embodiment.

Although illustrated in FIGS. 2-4 as roughly trapezoidal in cross-section, the filler rings 210 may have any desired cross-section, including rectangular.

The use of filler rings as described above provides pinch points at which the swellable elements may ride against the filler ring causing a boost to the holding power of the swellable element 120 with a surrounding casing or open hole. Traditionally, swellable packers have been limited on how short a swellable element could be used to achieve sufficient sealing. The improvement in the sealing ability of the packer caused by the filler rings 210 may allow a swellable packer 200, 300, or 400 to be made shorter than conventional swellable packers, while maintaining a desired pressure rating and sealing capability.

The embodiments described above describe a filler ring 210 that completely encircles the mandrel 110. In other embodiments, the filler ring 210 may not completely encircle the mandrel 110, but may form an arc that only partially surrounds the mandrel 110. In embodiments with multiple filler rings 210, the filler ring 210 may positioned at multiple positions around the circumference of the mandrel 110 as desired.

Although described herein in terms of packers, the techniques and filler rings described above are not limited to packers, but may be used in any type of downhole tool in which swellable elements are used for sealing with an open hole or casing. Similarly, although describe above as disposed on a mandrel 110, the filler ring 210 and swellable element 120 may be disposed on any desired type of tubular body.

The above description is intended to be illustrative, and not restrictive. For example, the above-described embodiments may be used in combination with each other. Many other embodiments will be apparent to those of skill in the art upon reviewing the above description. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A downhole tool, comprising:

a tubular body;

a swellable element, formed of a first swellable material, disposed about the tubular body; and a plurality of filler rings, formed of a second swellable material, different from the first swellable material, disposed about the tubular body between the tubular body and the swellable element, spaced along a length of the swellable element, wherein the filler ring are harder than the swellable element.

2. The downhole tool of claim 1, wherein the filler rings have a trapezoidal cross-section.

3. The downhole tool of claim 1, wherein the filler rings have a rectangular cross-section.

4. The downhole tool of claim 1, wherein the filler rings are fixed to the tubular body.

5. The downhole tool of claim 1, further comprising:

a plurality of screws fixing the filler rings to the tubular body.

6. The downhole tool of claim 1, wherein the filler rings are bonded to the tubular body.

7. The downhole tool of claim 1, wherein the swellable element is bonded to the tubular body.

8. The downhole tool of claim 1, wherein the swellable element is fixed to the tubular body by gage rings at each end of the swellable element.

9. The downhole tool of claim 1, further comprising:

a chamber, formed by a surface of the tubular body and a surface of the swellable element, wherein a first pressure external to the swellable element during insertion of the downhole tool is higher than a second pressure in the chamber.

10. The downhole tool of claim 1, wherein the downhole tool is a packer.

11. An apparatus for installation in a downhole tool having a swellable element disposed about a tubular body, comprising:

a plurality of filler rings formed of a filler ring swellable material harder than the swellable element, wherein the filler rings are configured to be disposed between the swellable element and the tubular body, spaced along a length of the swellable element.

12. The apparatus of claim 11, further comprising:

a plurality of screws configured to attach the filler rings to the tubular body.

13. The apparatus of claim 11, wherein the filler rings have a trapezoidal cross-section.

14. The apparatus of claim 11, wherein the filler rings have a rectangular cross-section.

15. A method of assembling a swellable downhole tool, comprising:

disposing a swellable element about a tubular body; and disposing a plurality of filler rings about the tubular body between the tubular body and the swellable element, spaced along a length of the swellable element, the filler rings formed of a swellable material harder than the swellable element.

16. The method of claim 15, further comprising: fixing the filler rings to the tubular body.

17. The method of claim 15, further comprising: forming a low-pressure chamber between the swellable element and the tubular body.

* * * * *